US005193589A

United States Patent [19]

Seiler

[11] Patent Number: 5,193,589

[45] Date of Patent: Mar. 16, 1993

[54] DOUBLE LIFT OPEN SHED JACQUARD MACHINE FOR PILE FABRIC

[75] Inventor: Wolfgang Seiler, Monchen-Gladbach, Fed. Rep. of Germany

[73] Assignee: Firma Oskar Schleicher, Monchen-Gladbach, Fed. Rep. of Germany

[21] Appl. No.: 818,814

[22] Filed: Jan. 10, 1992

[30] Foreign Application Priority Data

Jan. 18, 1991 [DE] Fed. Rep. of Germany ..... 4101778

[51] Int. Cl.[5] ..... D03C 3/12; D03C 3/24

[52] U.S. Cl. ..... 139/65

[58] Field of Search ..... 139/65, 21, 85, 59, 139/63, 64

[56] References Cited

U.S. PATENT DOCUMENTS 4,022,251 5/1977 Bucher ..... 139/65 X
4,023,598 5/1977 Bucher ..... 139/65 X
4,041,987 8/1977 Bucher ..... 139/65 X

*Primary Examiner*—Andrew M. Falik
*Attorney, Agent, or Firm*—Mason, Kolehmainen, Rathburn & Wyss

[57] ABSTRACT

In a double lift open shed Jacquard machine, for the production of pile fabric, blade carriers which are movable in opposite relationship to each other carry blades of a first kind with hooking engagement elements for hooks, which elements are disposed at the same given height. Blades of a second blade kind are also provided each having at least first and second spaced-apart hooking engagement elements and/or blades of a third blade kind are also provided whose hooking engagement elements are associated with the blade carrier in relatively movable relationship with such a transmission ratio that at the one dead center point of the lift movement of the blade carrier they correspond to the position in respect of height of the hooking engagement elements of the blades of the first kind while at the other dead center point they assume a position in respect of height which is different from the position of the hooking engagement elements of the blades of the first blade kind.

6 Claims, 2 Drawing Sheets

DOUBLE LIFT OPEN SHED JACQUARD MACHINE FOR PILE FABRIC

BACKGROUND OF THE INVENTION

One form of double lift open shed Jacquard machine for a loom for the production of pile fabrics, for example carpet fabrics, comprises lift blades which are movable in opposite relationship to each other and which are carried on blade carriers, and hooks which can be entrained by the lift blades in a hooking engagement position. A problem which arises in relation to Jacquard machines for the production of pile fabrics is that of providing three positions for the pile threads of the loom so that three shed positions can be produced in the loom. In order to afford the three positions required, each pile thread may have associated therewith double the number of control elements. That however gives rise to the problem that the machine then becomes excessively large as, with double the number of control elements, that means that the size of the machine is also doubled.

In another form of double lift open shed Jacquard machine comprising lift blades which are movable in opposite relationship to each other and which are disposed on blade carriers, with hooks which can be entrained by the lift blades in an engagement position, as disclosed in EP 0 280 132 Al, only one control device is operatively associated with each pile thread. To achieve that, each hook has three hook configurations, with two hook configurations being provided for movable lift blades and a third hook configuration being provided to give the open shed arresting action. Mounted to the hooks are pulley-type pull cords which are passed over a pulley and which at the other end are secured to movable suspension devices of a board-like configuration. The suspension devices are separately controllable. Thus, that arrangement provides that two positions are afforded within the Jacquard machine while the third position is afforded by virtue of the controllable suspension devices and the pulleys, outside of or below the Jacquard machine. That however involves a relatively large amount of mechanical structure outside the Jacquard machine and furthermore requires a corresponding amount of space beneath the Jacquard machine. The control assemblies required for controlling the board-like mechanical suspension devices are also disposed within the Jacquard machine in addition to the control devices which are provided therein in any case.

SUMMARY OF THE INVENTION

An object of the present invention is to provide a double lift open shed Jacquard machine which is of such a configuration as to be capable of providing first, second and third positions in respect of the pile threads with a small number of control elements and with minimum space requirement.

Another object of the present invention is to provide a double lift open shed Jacquard machine for a loom for the production of a pile fabric which is of a simple design configuration and in which only one control unit is associated with each pile thread.

Still another object of the present invention is to provide a double lift open shed Jacquard machine for a loom for the production of a pile fabric which is such as to afford substantial reliability of operation without involving major structural complications.

In accordance with the present invention, those and other objects are achieved in a double lift open shed Jacquard machine for a loom for the production of pile fabrics, comprising lift blades which are carried on blade carriers and which are movable thereby in opposite relationship to each other. Hooking engagement elements are disposed on respective ones of the lift blades and hooks are adapted to be entrained by the lift blades in a hooking engagement position thereof with said hooking engagement elements. The blade carriers have blades of a first blade kind with hooking engagement elements disposed at least substantially the same given height for the hooks and blades of a second blade kind each with at least two spaced-apart hooking engagement elements and/or blades of a third blade kind whose hooking engagement elements are associated with the blade carrier in relatively movable relationship in such a transmission ratio, for example a step-down or step-up ratio, that at the one dead center point in the lift movement of the blade carrier they correspond to the position in respect of height of the hooking engagement elements of the blades of the first blade kind while at the other dead center point they assume a position in respect of height which is different from the position of the hooking engagement elements of the first blade kind.

In that arrangement, the central position which is desired in each case in addition to the lower and upper positions can be attained on the one hand by the blades of the second kind and on the other hand by the blades of the third kind. During the lift blade movement in an upward direction for example the hooking engagement elements of the blades of the third blade kind are slowed down relative to the lift movement of the blades of the first blade kind so that, when the hooking engagement element of the respective blade of the first kind has reached a top dead center point, the hooking engagement element of the blade of the third blade kind, which is carried on the same blade carrier, has covered half the distance, more particularly because the hooking engagement elements of the blades of the third kind are associated with the blade carrier in such a way as to be relatively movable in a transmission ratio as indicated hereinbefore. The central position can also be achieved by the action of the blades of the second blade kind as those blades each have first and second hooking engagement elements which are disposed at a spacing thereon.

As will be apparent, more particularly from the following description of a preferred embodiment, the arrangement according to the invention does not require any additional control assemblies within the Jacquard machine or any mechanisms comparable to the movable suspension devices referred to above, beneath the Jacquard machine.

A preferred feature of the invention provides that blades of the first and second blade kinds are associated with a first blade carrier and blades of the first and third blade kinds are associated with a second blade carrier.

In another preferred feature of the invention the hooking engagement elements of the blades of the second blade kind are disposed at least substantially at the same height as the hooking engagement elements of the blades of the first blade kind.

Further objects, features and advantages of the invention will be apparent from the following description of a preferred embodiment of the invention.

DESCRIPTION OF THE PREFERRED EMBODIMENT

Figure 1:
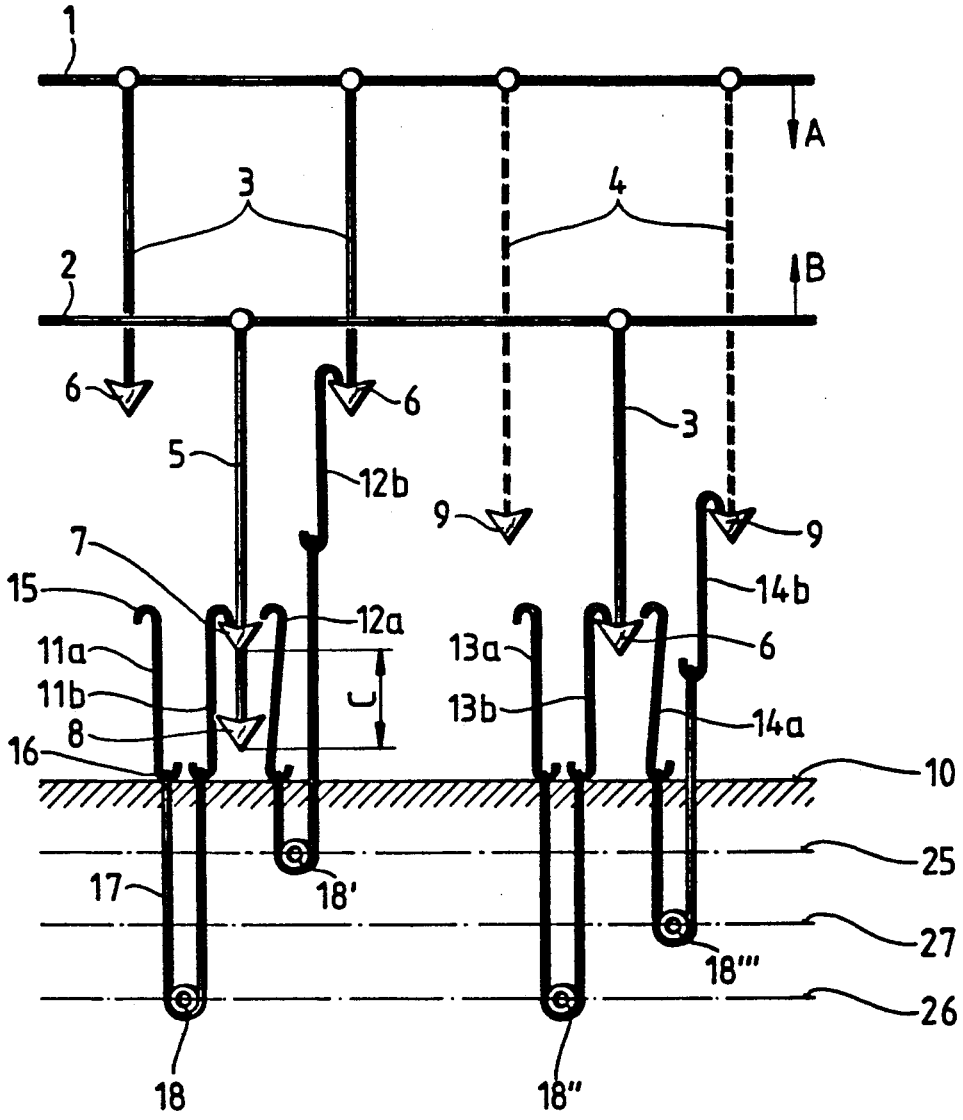
FIG. 1 is a diagrammatic view of a double lift open shed Jacquard machine, illustrating only the components which are essential for describing the present invention, with the blade carriers at the one dead center point in their movement.

Referring firstly to FIG. 1, shown therein is a double lift open shed Jacquard machine comprising first and second blade carriers 1 and 2 which are movable in opposite relationship to each other as indicated by the arrows A and B by way of suitable drive means (not shown). Blades 3 of a first blade kind and blades 4 of a third blade kind are mounted to the blade carrier 1. Blades 5 of a second blade kind and blades 3 of the first blade kind are carried on the blade carrier 2.

The blades 3 of the first blade kind have hooking engagement elements 6 which are disposed at the same heights or levels on the respective blades. The hooking engagement elements 6 are of a double-sided configuration, as can be clearly seen from the drawing. The blades 5 of the second blade kind each comprise first and second hooking engagement elements 7 and 8 which are disposed at a spacing from each other in the longitudinal direction of the respective blade 5, as indicated by the arrow C in FIG. 1. The hooking engagement elements 7 and 8 are also of a double-sided configuration. The blades 4 of the third blade kind each have hooking engagement elements which are indicated at 9 and which are also of a double-sided configuration.

Reference numeral 10 indicates a hook bottom member, above which are disposed hooks as indicated in pairs at 11*a*, 11*b*; 12*a*, 12*b*; 13*a*, 13*b*; and 14*a*, 14*b*. Each hook has an upper hook portion or configuration which can be clearly seen in for example FIG. 1 but which is only indicated in respect of the hook 11*a*, at 15. Connected to the base of each hook, as indicated only in respect of the hook 11*a* by reference numeral 16, is a respective flexible connecting member 17 which forms a loop configuration. The loop configuration which thus extends between the base portions of each two adjacent hooks, beneath the hook bottom member 10, carries a respective roller or pulley as indicated at 18, 18', 18'' and 18''' respectively, to which a respective harness thread (not shown) can be appropriately secured.

The hooks 11*a*, 11*b*; 12*a*, 12*b*; 13*a*, 13*b*; 14*a*, 14*b* are pivotable by way of suitable control devices (not shown) between an engagement position in which they can be engaged by and entrained by the respectively associated lift blades, and a non-engagement or non-hooking position in which they are not entrainable by the lift blades. Looking at FIG. 1, the hooks 11*b* and 13*b* are shown in the engagement position while the hooks 12*a* and 14*a* are shown in the non-engagement position. That is as far as the hooks which are resting on the hook bottom member 10 are concerned. The hooks 12*b* and 14*b* which are raised from the hook bottom member 10 were in an engagement position when the blades 3 and 4 respectively were in their bottom dead center position and those hooks were accordingly entrained by the operatively associated blades.

Figure 2:
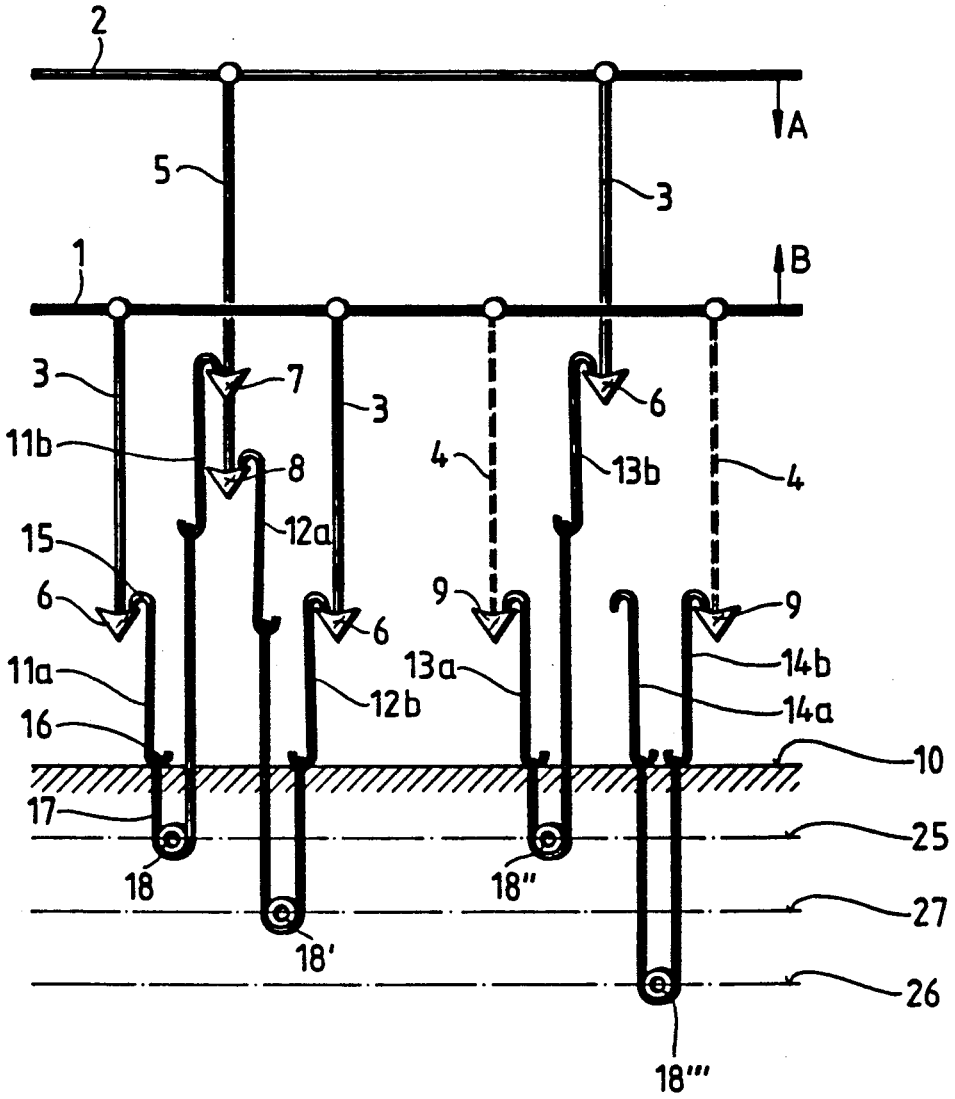
FIG. 2 is a view corresponding to that shown in FIG. 1, but with the blade carriers at the other dead center point in their movement.
Figure 3:
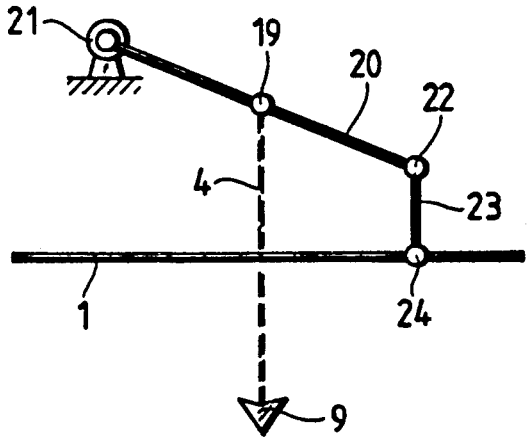
FIG. 3 shows an embodiment of a step-down transmission device operatively disposed between a hooking engagement element of a blade of the third kind and the associated blade carrier.

It will be seen that the blades 4 of the third kind are shown in the drawings in the form of broken lines. The broken-line illustration of the blades 4 is intended to show that between the hooking engagement elements 9 and the blade carrier 1 which carries the blades 4, there is a connection which is variable in respect of length. That can be achieved for example by the step-down transmission assembly which is diagrammatically shown in FIG. 3. To produce the appropriate transmission ratio, the upper end 19 of the respective blade 4 is pivotally connected to a lever 20 at a location intermediate the ends thereof. At one end, as indicated at 21, the lever 20 is pivotably mounted at a stationary location, as on a suitable part of the machine frame structure, while at its other end as indicated at 22 the lever 20 is connected to one end of a connecting link 23, the other, lower, end of which is pivotally connected at 24 to the blade carrier 1. The relationships in respect of length in that arrangement are so selected that, when the blade carrier 1 is in its lower dead center point position as shown in FIG. 2, the position in respect of height of the hooking engagement elements 9 on the blades 4 of the third kind corresponds to the position in respect of height of the hooking engagement elements 6 of the blades 3 of the first blade kind, but that in the other or upper dead center position which is shown in FIG. 1, the hooking engagement elements 9 of the blades 4 of the third blade kind assume a position in respect of height which is different from the position of the hooking engagement elements 6 of the blades 3 of the first blade kind, more specifically being an intermediate or central position which approximately corresponds to half the stroke movement of the hooking engagement elements 6 of the blades 3. In that way it is possible to provide for a central position of the harness thread, between the two extreme positions. Looking at FIG. 1, beneath the hook bottom member 10, the extreme positions are indicated at 25 and 26 therein, while the central position of the harness threads is indicated at 27. Thus, in FIG. 1, the roller 18 which is shown at the extreme left is in the lower position 26 while the roller 18' which is to the right thereof assumes the upper limit position 25. The next adjoining roller 18'' towards the right in FIG. 1 is in the lower position 26 while the extreme right-hand roller 18''' in FIG. 1 is in the intermediate or central position 27.

In FIG. 2, in which the blade carrier 1 is in its lower dead center point position and the blade carrier 2 is in its top dead center point position, the roller 18 at extreme left is in the upper position 25, while the roller 18' adjoining same towards the right is in the intermediate or central position 27. The next adjoining roller 18'' towards the right is in the upper position 25 and the extreme right-hand roller 18''' is in the lower limit position 26.

As already mentioned, the blade carrier 2, in addition to the blades 3 of the first blade kind, also carries blade 5 of the second blade kind which have the first and second spaced-apart hooking engagement elements 7 and 8. FIG. 1 shows the hook 11*b* in the hooking engagement position relative to the upper hooking engagement element 7 while the hook 12*a* is shown in the non-engagement position in relation to the hooking engagement element 7. If now the blade 5 is moved upwardly, the hook 11*b* will also be entrained upwardly while the hook 12*a* will remain in the position shown in FIG. 1. After the blade 5 has moved upwardly by a certain distance, the hook 12*a* moves out of its non-engagement position into an engagement position, for example due to the action of a spring or the like, so that the hook 12*a* is then entrained upwardly by the second hooking engagement element 8, whereby it moves into the position shown in FIG. 2. In that way the roller 18' is moved from the upper position 25 shown in FIG. 1 into the intermediate position indicated at 27 in FIG. 2, that movement being further promoted also by virtue of the fact that the hook 12*b* has moved downwardly with the blade 3 supporting same, as its blade carrier 1 moves downwardly as the other blade carrier 2 moves upwardly.

Thus, in each operating lift movement, the above-described assembly can provide for three different positions 25, 26 and 27 for the harness threads, both with the blade carrier 1 and also with the blade carrier 2.

It will be appreciated that the above-described construction has been set forth solely by way of example and illustration of the principles of the present invention and that various modifications and alterations may be made therein without thereby departing from the spirit and scope of the invention.

What is claimed is:

1. A double lift open shed Jacquard machine for a loom for the production of pile fabric, comprising: first and second blade carriers which are movable in opposite relationship to each other; lift blades carried by the first and second blade carriers; hooking engagement means on respective ones of the lift blades; and hooks adapted to be entrained by said lift blades in an engagement position with said hooking engagement means, wherein the first and second blade carriers have lift blades of a first blade kind with hooking engagement means disposed at substantially the same given height for the hooks, and at least one of said blade carriers having at least one lift blade of a second blade kind in which each lift blade of the second blade kind has at least two spaced-apart hooking engagement means and lift blades of a third blade kind in which the hooking engagement means are associated with an associated blade carrier in relatively movable relationship in such a transmission ratio that at one dead center point in the movement of the associated blade carrier the hooking engagement means of the lift blades of the third blade kind correspond to the position in respect of height of the hooking engagement means of the lift blades of the first blade kind and at an opposite dead center point in the movement of the associated blade carrier the hooking engagement means of the lift blades of the third blade kind assume a position in respect of height which is different from the position of the hooking engagement means of the first blade kind.

2. A machine as set forth in claim 1 wherein said transmission ratio is a step-down ratio including a connecting link pivotally connected to said associated blade carrier and a lever pivotally mounted at a first end to a stationary location and connected to said connecting link at a second, opposite end thereof, and an upper end of said lift blade of the third kind connected to said lever between said first and second ends thereof.

3. A machine as set forth in claim 1 wherein lift blades of said first and second kinds are associated with said first blade carrier and lift blades of said first and third kinds are associated with said second blade carrier.

4. A machine as set forth in claim 3 wherein the hooking engagement means of the lift blades of said second kind are disposed at substantially the same height as the hooking engagement means of the lift blades of said first kind.

5. A double lift open shed Jacquard machine for a loom for the production of pile fabric comprising: blade carriers; means for moving the blade carriers in mutually opposite relationship; a plurality of lift blades carried by respective ones of the blade carriers; respective hooking engagement means on each of the lift blades; and hooks adapted to be entrained by said lift blades in the movement thereof with the blade carriers in a position of engagement with said hooking engagement means, wherein the lift blades comprise lift blades of a first kind having hooking engagement means disposed at substantially the same height for engagement with the associated hooks, at least one lift blade of a second kind in which each lift blade of the second kind has first and second hooking engagement means disposed on the respective lift blade at a spacing from each other in the longitudinal direction of the lift blade, and lift blades of a third kind in which the hooking engagement elements are operatively associated with the respective blade carrier in relatively movable relationship therewith in a motion transmission ratio such that at one dead center point in the movement of the said blade carrier the hooking engagement means of the lift blades of said third kind correspond to the position in respect of height of the hooking engagement means of said blades of said first kind and at an opposite dead center point the hooking engagement means of the blades of said third kind assume a position in respect of height which is different from the position of the hooking engagement means of the lift blades of said first kind.

6. A machine as set forth in claim 5 wherein a said first blade carrier carries blades of said first and second kinds and a second blade carrier carries blades of said first and third kinds.

* * * * *